United States Patent [19]

Hardin, Jr. et al.

[11] Patent Number: 5,009,542

[45] Date of Patent: Apr. 23, 1991

[54] TRAFFIC BARRIER GATE

[76] Inventors: Paul W. Hardin, Jr., 3086 Parklane, Snellville, Ga. 30278; Wayne Taylor, 5202 Vivid Dr., Stone Mountain, Ga. 30083

[21] Appl. No.: 489,346

[22] Filed: Mar. 6, 1990

[51] Int. Cl.[5] ..... E01F 13/00; E01F 15/00

[52] U.S. Cl. ..... 404/6; 404/9

[58] Field of Search ..... 404/6, 9-11; 49/35, 49, 131

[56] References Cited

U.S. PATENT DOCUMENTS

| | | | |
|---|---|---|---|
| 1,370,689 | 3/1921 | Hearn | 49/33 |
| 1,759,207 | 5/1930 | Rose et al. | 49/33 |
| 2,024,063 | 12/1935 | Roper | 49/131 |
| 3,775,912 | 12/1973 | Walls | 49/131 |
| 4,231,190 | 11/1980 | Tieben | 49/25 |
| 4,367,975 | 1/1983 | Tyers | 49/49 |
| 4,490,068 | 12/1984 | Dickinson | 404/6 |
| 4,630,395 | 12/1986 | Nasatka | 404/6 |
| 4,632,598 | 12/1986 | Richards | 404/9 X |
| 4,690,583 | 9/1987 | Faulconer | 404/6 |
| 4,699,197 | 10/1987 | Hamrick | 404/6 |
| 4,705,426 | 11/1987 | Perea | 404/6 |
| 4,708,515 | 11/1987 | Davies | 404/6 |
| 4,752,152 | 6/1988 | Crisp et al. | 160/188 |
| 4,762,439 | 8/1988 | Carlyle | 40/49 X |
| 4,775,261 | 10/1988 | Fladung | 49/49 X |
| 4,818,136 | 4/1989 | Nasatka et al. | 404/6 |
| 4,850,737 | 7/1989 | Nasatka et al. | 404/6 |
| 4,893,119 | 1/1990 | Nasatka | 404/6 X |

FOREIGN PATENT DOCUMENTS

| | | | |
|---|---|---|---|
| 3606158 | 8/1987 | Fed. Rep. of Germany | 49/49 |
| 3611372 | 10/1987 | Fed. Rep. of Germany | 49/49 |
| 158884 | 5/1957 | Sweden | 49/131 |

*Primary Examiner*—Ramon S. Britts
*Assistant Examiner*—Gay Ann Spahn
*Attorney, Agent, or Firm*—James A. Hinkle

[57] ABSTRACT

A traffic barrier gate for controlling the flow of vehicles through a barrier, such as a concrete median wall between opposing traffic lanes of a controlled access highway. In one embodiment the gate comprises hinged sidewall panels connected to a support member which is moved vertically on command and which, when moved, causes the sidewall panels to collapse and spread out thereby forming a ramp for the passage of vehicles through the wall barrier. In a second embodiment, the gate revolves 180°, upon command, and then retracts into a well in the ground thereby forming the traffic ramp.

11 Claims, 6 Drawing Sheets

TRAFFIC BARRIER GATE

BACKGROUND OF THE INVENTION

I. Field of the Invention

The present invention relates to traffic barriers and more particularly, although not exclusively, to traffic barriers for controlling access across highway concrete median barriers from one set of traffic lanes to the other. The present invention further relates to traffic barriers which can be utilized to selectively prohibit vehicular travel on any highway.

II. Description of the Prior Art

Existing barriers, for controlling the flow of vehicle traffic, generally comprise either a hinged arm which raises and lowers to block a defined area, or a type of hinged plate which may be raised or lowered from a ground level position to obstruct an approaching vehicle.

Such barriers may be utilized for any number of purposes, such as providing ingress and egress to property, to provide access to public thoroughfares, or in the control of terrorist activities to prevent high speed barrier breaches by terrorist vehicles at high security locations.

The prior art has never addressed a practical solution for allowing a safe and easily utilized gate to be provided in concrete highway median barriers for allowing emergency and authorized vehicles to have access from one set of traffic lanes to the other.

SUMMARY OF THE INVENTION

It is, therefore, an object of the present invention to provide a vehicle security barrier for selectively controlling vehicular traffic on the roadway. The present invention contemplates providing, in the environment of concrete median highway barriers separating opposing lanes of traffic, a selectively operable member which may be opened on command to allow emergency and authorized vehicles access from one set of traffic lanes to the other.

It is yet another object of the invention to provide a selectively operable traffic barrier system to selectively allow traffic access to desired locations.

Another object of the invention is the provision of a selectively operable traffic safety barrier positioned within selected locations of a concrete traffic median barrier which may be, on command, collapsed to a relatively flat ramp to allow vehicular traffic access through the concrete barrier in order to gain access to another set of traffic lanes.

Yet another object is to provide another embodiment of the present invention which will allow vehicular access through a concrete traffic highway barrier wherein, upon command, a selected section of the barrier is rotated and positioned downwardly into a receiving aperture so that the selected barrier is essentially flush to the road surface thereby allowing authorized traffic through the barrier from one set of traffic lanes to the other.

Other objects, advantages and capabilities of the invention will become apparent from the following description, taken in conjunction with the accompanying drawings, showing only preferred embodiments of the invention.

DESCRIPTION OF THE PREFERRED EMBODIMENT

Figure 1:
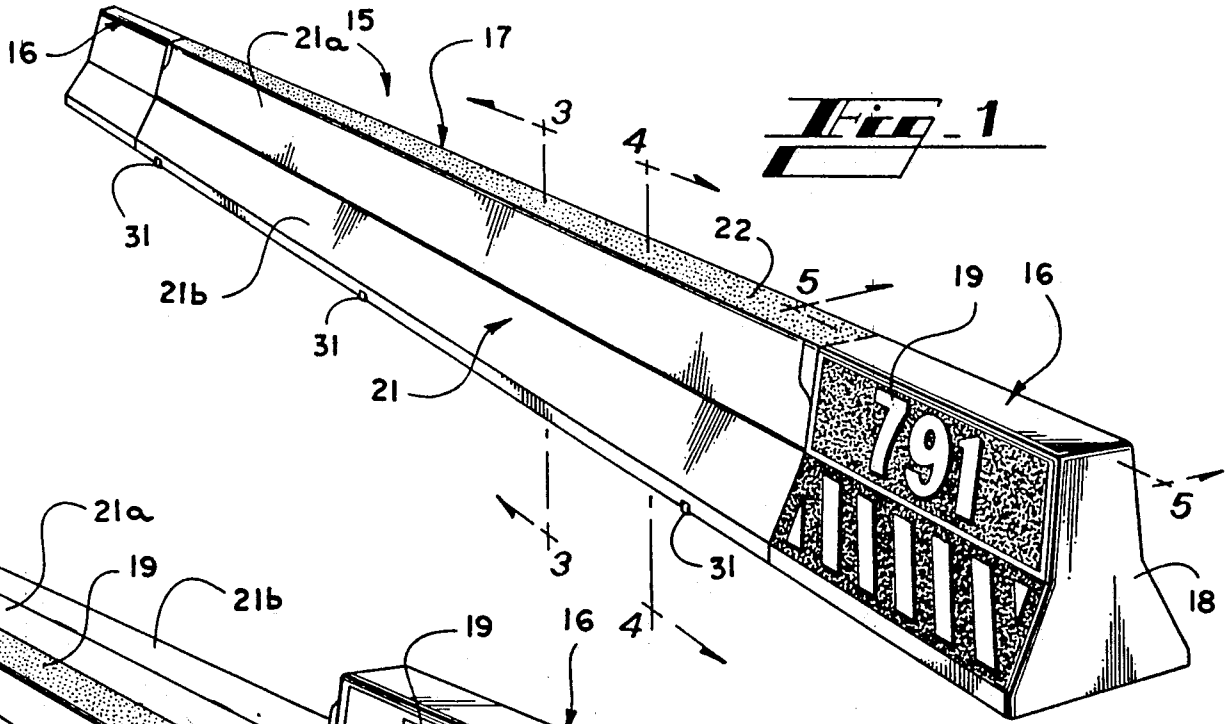
FIG. 1 is an overall perspective view of one embodiment of the invention showing a collapsible barrier gate in the closed, or upright, position.

Referring to the drawings, wherein like numerals designate corresponding parts throughout the several figures, the barrier gate of the present invention is generally indicated by numeral 15. The barrier generally comprises, as can be readily seen in FIG. 1, an elongated structural member which has a matching configuration to the typical highway concrete barrier that exists in the median strip between opposing roadway sections. Generally, it is anticipated that when a concrete highway barrier is installed, certain sections will be left open so that the barrier gate herein described will be able to be placed within the opening for the purposes desired. The properly designed barrier gate of this invention will provide the structural rigidity and necessary safety features in accordance with applicable highway standards of the federal government and the various states.

The barrier gate 15 comprises one or more operating housings 16 which flank the gate portion 17 of the unit, within the operating housing 16 will be the various control systems necessary to operate the gate portion 17. The present invention shows a pair of operating housings 16 at either end of the gate portion, but it should be noted that the gate, depending on its size, weight and other factors, may well only need an operating housing at one end thereof and, therefore, the present description should take in consideration that, for illustrative purposes, only a pair of operating housings are shown, and these housings would be essentially mirror images of one another. The shape and size of the barrier gate 15 would match the shape and size requirements of standard highway concrete barriers for the area in which the gates are installed. Each operating housing 16 would be enclosed with a housing end panel 18 which would abut the end section of the highway concrete barrier to provide a unitary structure.

It is anticipated that at one or both ends of the barrier gate, a gate identification number 19 would be installed for use by the emergency vehicles utilizing the gate. The gate portion 17 would generally comprise a plurality of barrier panels 21 on each side of the gate portion, and so interconnected and configured as to match the highway concrete barrier configuration. To keep the adverse elements out of the inter-workings of the gate portion, a weather seal 22 would overlay the topmost surfaces of the individual barrier panels 21.

Figure 2:
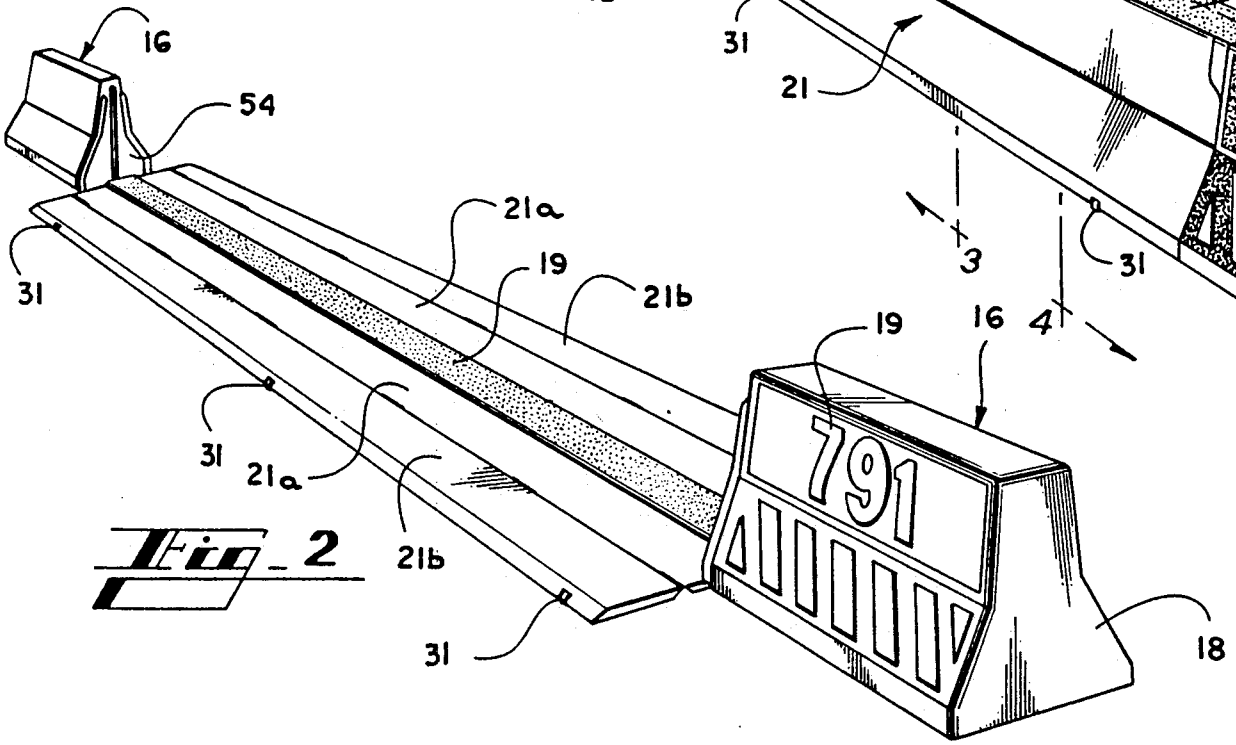
FIG. 2 is a perspective view of the barrier gate of FIG. 1 showing the gate in the collapsed, or lowered, position thereby allowing traffic flow through the barrier.

When an emergency or authorized vehicle desires access to the gate, the gate will be lowered to the open position, as can be seen in FIG. 2, to allow the vehicle to drive across the gate portion to access the other side of the barrier gate 15. Control systems for effecting raising and lowering of the gate are well known, and it is anticipated that the operation may be effected by manual or automatic means. For instance, an electrical switch could be provided to energize the necessary raising and lowering motor control systems, or the emergency vehicle could be equipped with a radio control device, much like standard door or gate opening systems, and would send an operating signal to a receiving unit within the barrier gate to cause the gate portion to raise or lower on command.

Figures 3, 4:
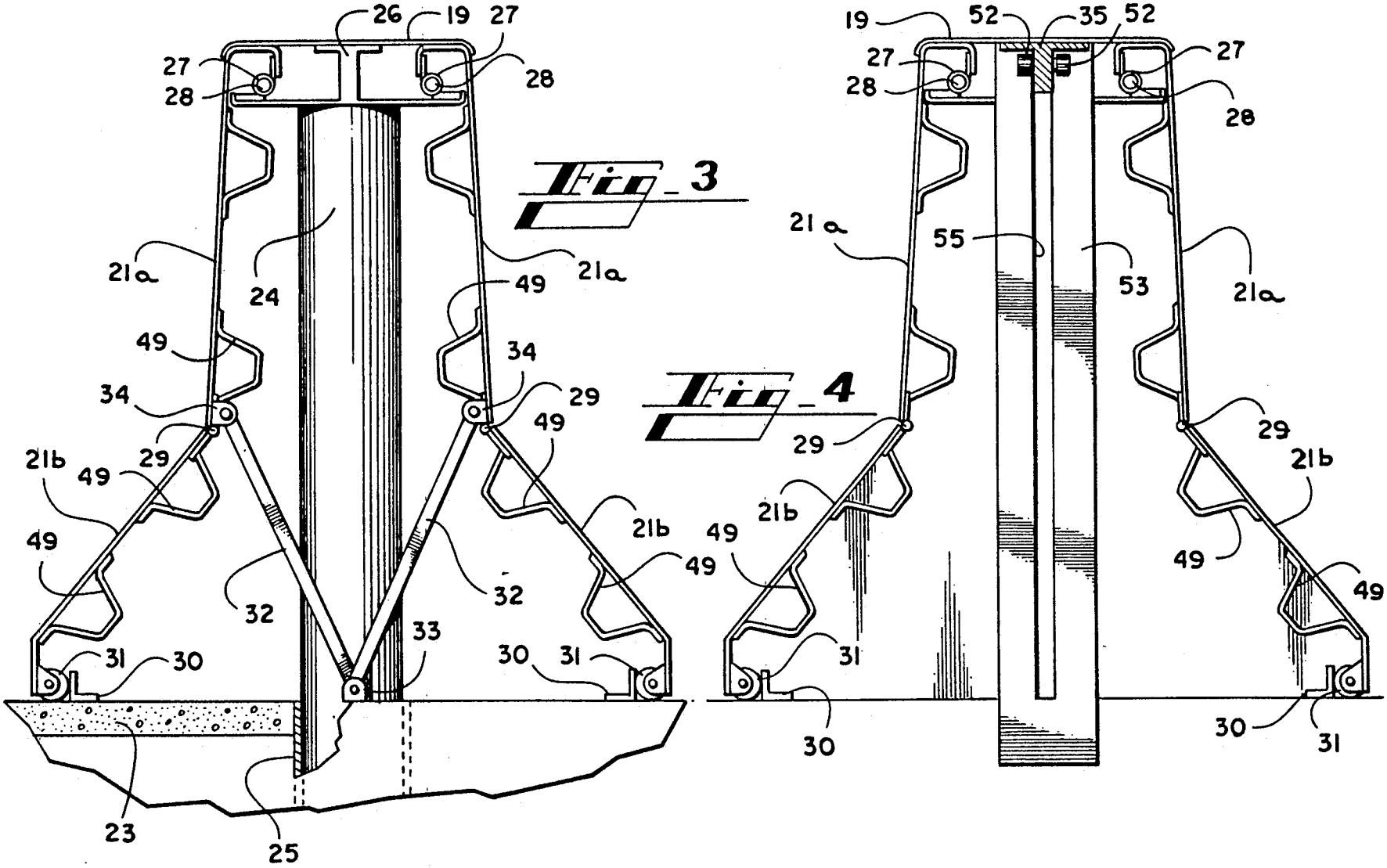
FIG. 3 is a vertical section view of the barrier contemplated by the present invention taken along lines 3—3 of FIG. 1.
FIG. 4 is a vertical section view taken generally along lines 4—4 of FIG. 1.

Turning now to FIG. 3, which shows a vertical section of the gate portion 17, it is seen that the barrier gate 15 will rest upon the road surface 23 and will be maintained in place by means of a support tube 24 being reciprocally received within a receiving tube 25 mounted in the ground beneath the roadway surface. The receiving tube 25 will need to be only of a sufficient length to receive the support tube 24, but will undoubtedly be of sufficient strength to provide structural rigidity to the barrier gate in its closed, upright position. While the present disclosure presents the support tube 24 as being a unitary piece, it is anticipated that a telescoping tube could be utilized, thereby reducing the length of the ground receiving tube 25.

Positioned above the support tube 24 is a longitudinal support spine beam 26 which runs along the longitudinal length of the barrier gate to provide both structural rigidity and to support the gate panels. The upper barrier panel 21(*a*) is hingedly attached to the spine beam 26, at hinge 27, which allows rotational movement of panel 21(*a*) about hinge shaft 28. The upper barrier panel 21(*a*) is so mounted about hinge 27 that it projects downwardly and terminates at a distal edge thereof where a panel connecting hinge 29 connects barrier panel 21(*a*) with the lower barrier panel 21(*b*).

The lower barrier panel 21(*b*) projects downwardly and outwardly from upper panel 21(*a*) to form a basic configuration of the desired barrier gate, and terminates at the distal end thereof in a ground engaging roller caster 31.

As is depicted in FIGS. 3 and 4, the roller casters 31 abut an angle member 30 which acts as a positive stop to the roller casters 31 so that the casters cannot be easily forced inwardly toward the center of the barrier gate. It is anticipated that there will be one or more support tubes 24 throughout the length of the barrier gate and the number would be dictated by structural rigidity requirements and the length of the gate itself. To assist in the raising and lowering of the barrier panels 21, there are provided spanner supports 32 which are hingedly mounted to a fixed surface near the road surface by hinge 33 at one end thereof, and at the other end thereof to an upper spanner hinge 34. The spanner supports 32 assist in maintaining the shape of the barrier gate in its closed position, and will assist in the raising and lowering of the gate during the operating cycle. Further, the supports 32 will maintain the relative position of the panels with respect to one another during opening and closing.

Figure 5:
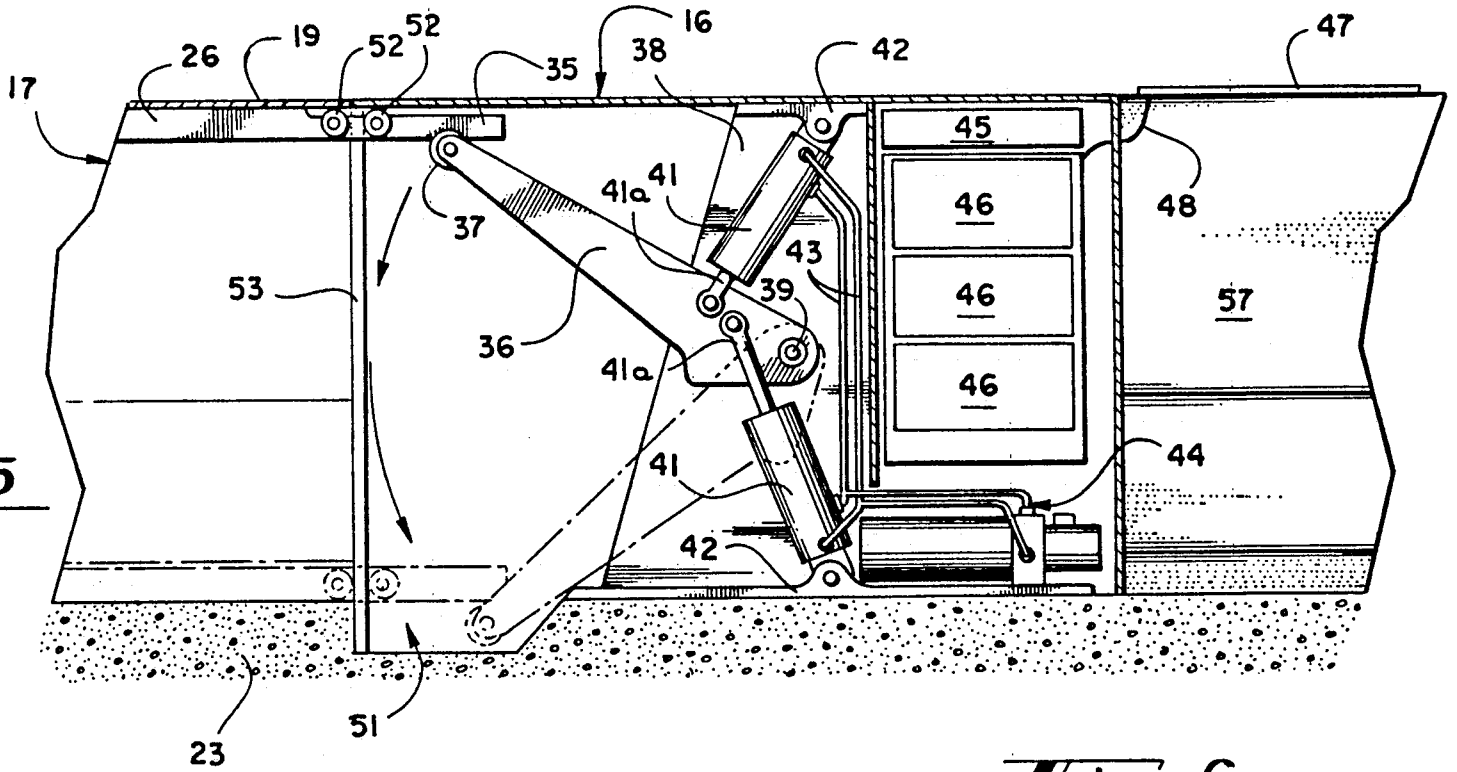
FIG. 5 is generally a vertical section view of the operating housing taken along lines 5—5 of FIG. 1.

As previously mentioned, the operating housing 16 encloses the necessary mechanisms for raising and lowering the barrier gate portion 17. To accomplish the raising and lowering, the spine beam 26 has an extension 35 projecting into the housing 16. Cooperating with the spine extension 35, is a lifting boom 36 which engages the extension 35 by means of a suitable boom roller support 37, which effects a rolling motion between the lifting boom 36 and the spine extension 35 thereby allowing the collapsing, or lowering, of the gate portion 17 at desired times As is seen in FIG. 5, the arcuate motion of the lifting boom roller support 37 will allow the gate portion 17 to collapse to ground level when the lifting boom 36 is lowered to its full extent. The proximal end of the lifting boom 36 is mounted to a rigid boom mounting plate 38 around boom pivot 39.

To effect the raising and lowering of the lifting boom 36, it is anticipated that one or more hydraulic cylinders 41, and respective operating rods 41(*a*), will be connected between the lifting boom 36 and respective cylinder mounting brackets 42. While it may well be feasible to operate the barrier gate lifting boom of the present invention with one operating hydraulic cylinder 41, it has been found that a pair of co-acting hydraulic cylinders will provide greater positive control wherein one cylinder will be in the pushing mode and the other cylinder will operate concurrently therewith in the drawing mode, thereby providing positive control of the lifting boom 36.

Hydraulic fluid will be supplied to the cylinders 41 through standard hydraulic hoses 43 from the motor and pump unit 44. It is anticipated that the motor and pump unit 44 will be interconnected with the operating signal receiving equipment 45. While any number of operating systems may be utilized as mentioned earlier, it is believed that for locations where power is not readily available it would be feasible to operate the barrier gate by electrical energy stored in batteries 46, which would be kept charged by a solar collector 47 transferring electrical energy through cable 48.

Figure 6:
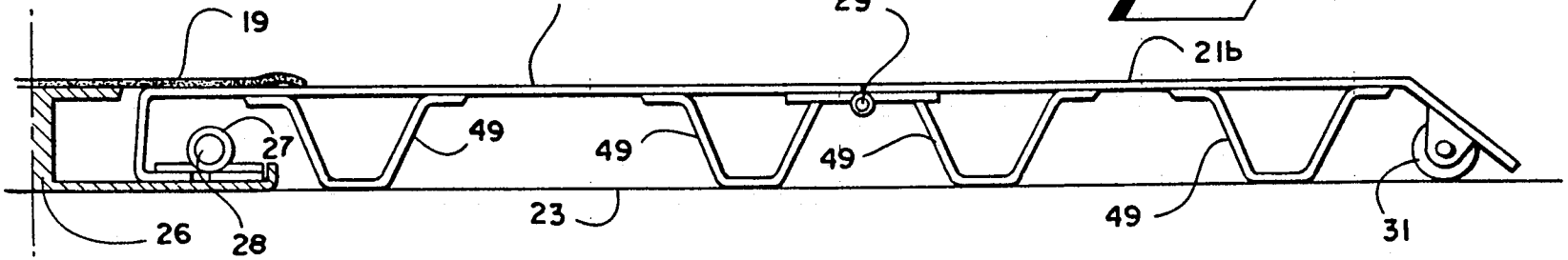
FIG. 6 is a partial vertical section view of the lowered ramp as shown in FIG. 2.

Referring now to FIG. 6 which shows the gate portion 17 in the collapsed, or open, position, it can be seen that when, in the open position, the gate rests upon the roadway surface 23 by means of support rails 49 which provide the necessary structural rigidity to support vehicles crossing the open gate. In the open position the proximal end of the barrier panels 21(*a*) are supported by the spine beam 26, support rails 49 and by the roller casters 31. To operate the embodiment just described, an emergency vehicle would signal the barrier gate 15 to open by sending the desired radio signal to the receiving equipment 45 which would cause the motor and pump unit 44 to energize and supply hydraulic fluid to the hydraulic cylinders 41, thereby effecting a downward movement of the boom roller support 37 to the final position wherein the boom roller support 37 rests within the boom end recess 51. FIG. 5 shows, in phantom lines, the open position of the lifting boom 36 and the spine beam 26. As the gate begins to open, the roller casters on the lower barrier panels 21(*b*) begin moving outwardly carrying both the upper and lower barrier panels with them, thereby collapsing the support tube 24 into the ground receiving tube 25 and allowing the entire gate to collapse to the ground and to form a ramp structure which the authorized vehicle could cross.

To stabilize the barrier gate during the raising and lowering operations, it is anticipated that each spine extension 35 will have roller stabilizers 52 mounted in opposing pair relationship to cooperate with a bifurcated roller plate 53 mounted in association with the inside housing end panel 54. As can be seen from FIG. 4, the roller plate 53 has a spine receiving slot 55 in which the spine beam extension 35 is adapted to move in a vertical direction. The roller stabilizers 52 are so mounted on the beam extension 35 that opposing pairs will ride upon and engage the roller plate 53 to provide the gate portion longitudinal stability and to assist in the raising and lowering operation.

Another embodiment of the present invention is shown in FIGS. 7–12. It may be that in certain locations, and especially locations where space constraints dictate, the barrier gate 15, instead of collapsing and providing an extended ramp over which the emergency vehicle may drive, users of the system may well prefer that the barrier gate rotate and recess into a receiving cavity thereby eliminating the extension of the ramps to either side of the barrier median.

To satisfy just such a requirement, a gate 15 and revolving portion 56 is placed in a gap between the ends of the concrete median barrier 57. The revolving portion will be essentially self-contained without the necessity of the operating housings 16 as proposed in the first embodiment described earlier. However, this should not be limiting if it is found that the user desires to have separate operating housings 16 as opposed to having the entire operating portion of the mechanism housed within the revolving portion 56 as contemplated in this second embodiment.

Figures 7, 8:
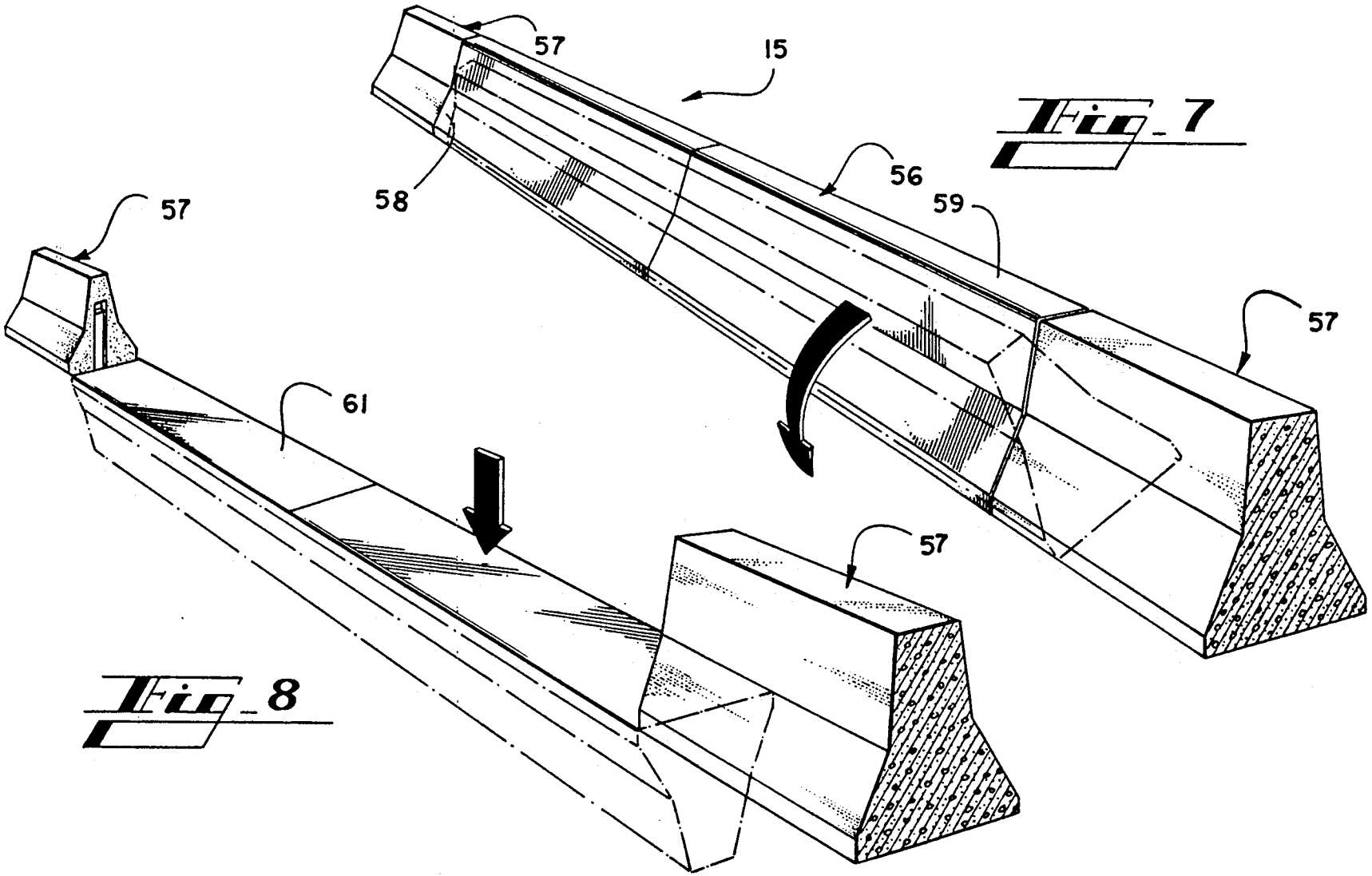
FIG. 7 is an overall perspective view of a second embodiment of the present invention in its closed, or upright, position.
FIG. 8 is a perspective view of the embodiment shown in FIG. 7 with the barrier shown rotated and positioned in a receiving well, thereby allowing access across a barrier gate.

As shown in FIGS. 7 and 8, the barrier gate portion 56 upon command, will, by mechanisms yet to be described, rotate about its longitudinal axis, as shown in a phantom lines of said Figures, then will turn 180 degrees and move into a receiving access within the roadway so that the entire gate portion 56 will provide the required ramp access.

In this embodiment it is contemplated that the gate portion 56 comprises a prefabricated gate conforming to the configuration of the median barrier 57 comprising side panels 58, a barrier top 59 and a barrier bottom 61.

Inasmuch as the operating mechanisms for the barrier 15 are housed within the structure of the gate 56, it is anticipated that access panels 62 will need to be provided to the gate in order to allow repairs to be made when necessary. Preferably these panels should be located in the barrier bottom 61 where the size of the gate allows adequate ingress and egress for the mechanic. In the present invention, which contemplates the operating mechanisms to be placed within the gate 56, there needs to be a provision for rotating the gate yet maintaining the operating mechanisms stationary. However, should it be desired that the operating mechanisms be placed in housing 16, as contemplated in the first embodiment, this could easily be accomplished and a stationary core about which the entire gate 56 would revolve, would not be necessary. Therefore, it is contemplated the gate 56 will revolve about stationary core 63. The mechanism for revolving gate 56 is more particularly shown in FIGS. 9–12.

The gate 56 is supported by elevating track 64 which stands vertically from the mounting pad 65 located within the receiving well 66. When an emergency vehicle desires to access the barrier 15, of the embodiment shown by FIG. 7, a control signal would activate the rotational control system and cause the barrier gate 56 to rotate and descend into the receiving well 66. This will be accomplished by signal receiving equipment such as was shown in FIG. 5, which equipment can be located within the gate 56 or other suitable area. The storage batteries 67 would then energize one or more electric rotational motors 68 causing the gate 56 to rotate and, once a 180 degree rotation is completed, the lift motors 69 interacting with the track 64 would then cause the entire gate assembly to descend into the receiving well.

Figure 9:
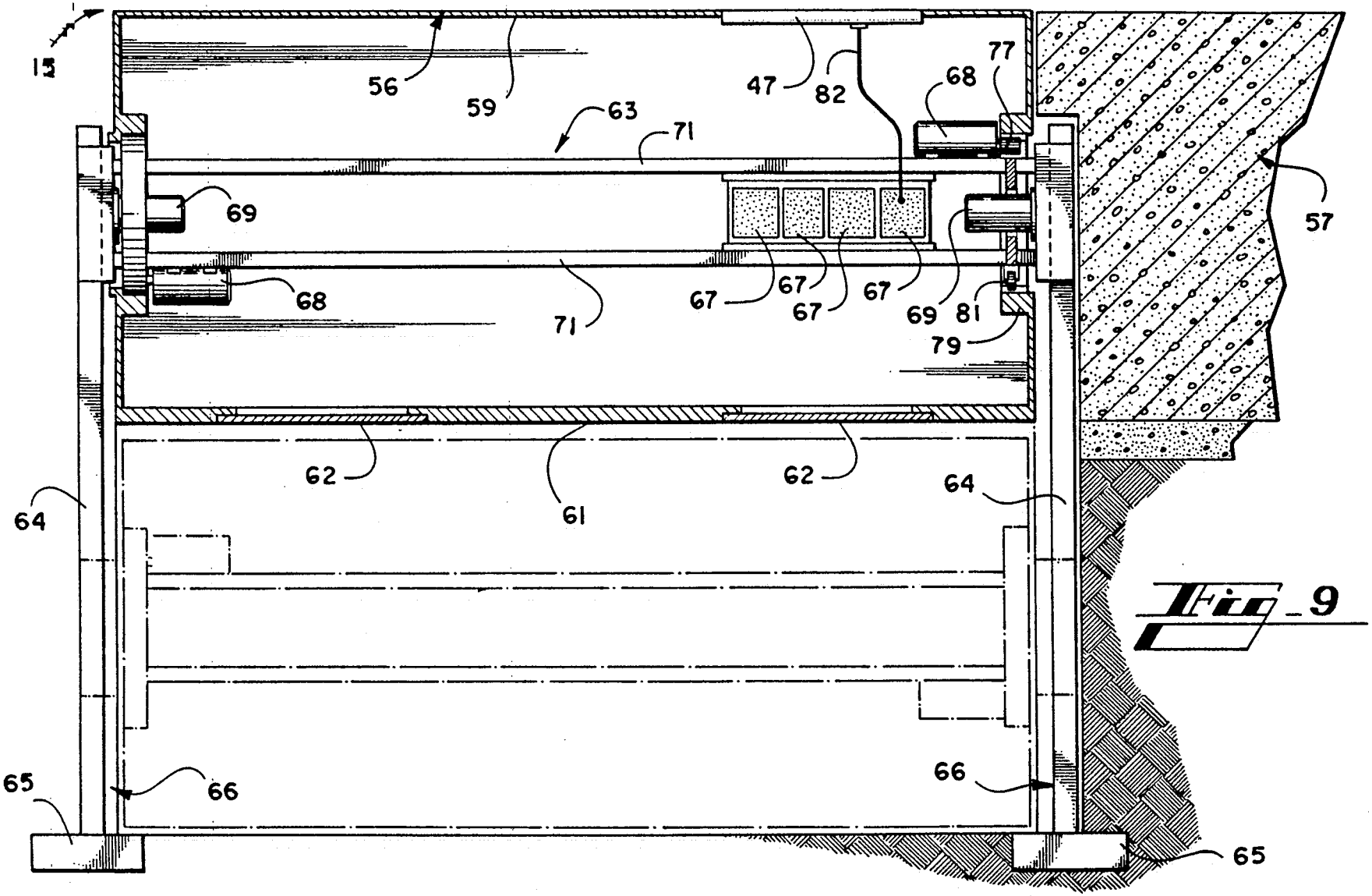
FIG. 9 is a vertical section view taken along the longitudinal length of FIG. 7 showing the alternate embodiment in the closed, or upright, position and also showing the relationship of the barrier gate in phantom lines in its open, or lowered, position.
Figure 11:
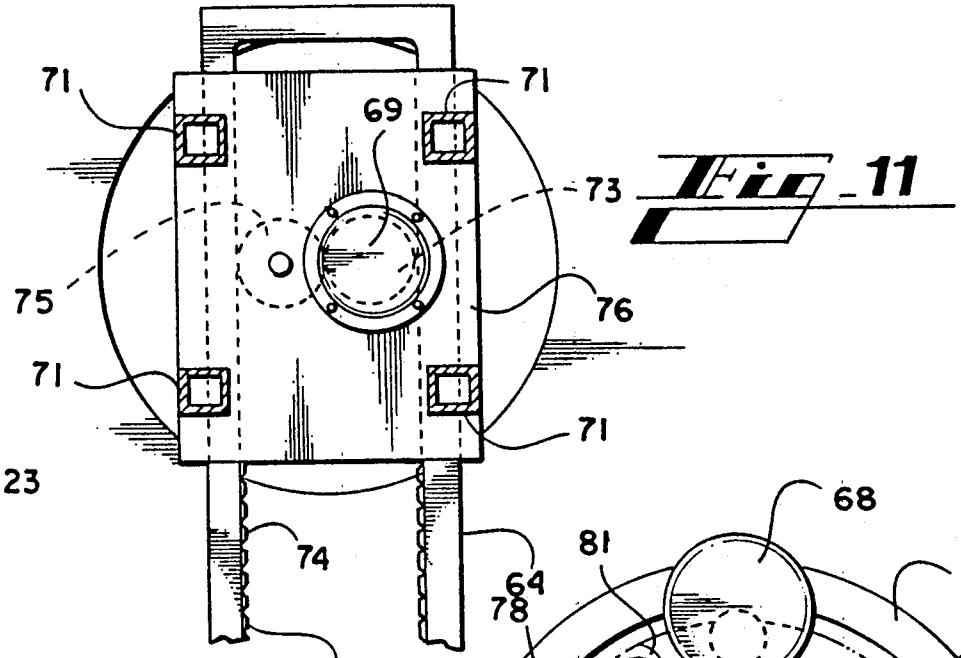
FIG. 11 is an enlarged partial vertical section view of the embodiment of FIG. 9 looking toward the end, and showing a drive motor and elevating track.

In the particular embodiment shown in FIG. 9, a plurality of reinforcing bar members 71 form the non-revolving core 63. Various elements are attached to the core 63 and are maintained from revolving when the gate 56 rotates. Once the gate 56 has fully rotated to the downward position. The lift motor 69 will rotate drive gear 73 which engages the track teeth 74 of the elevating track 64, thereby causing the entire inverted barrier gate to descend into the receiving well 66. To maintain the unit in a positive drive mode, it is anticipated that an idler gear 75 is mounted on motor support plate 76 in operative engagement with the drive gear 73 and teeth 74 thereby causing an even distribution of loading forces and thereby allowing the barrier gate to track vertically within the elevating track 64 without difficulty.

Figure 12:
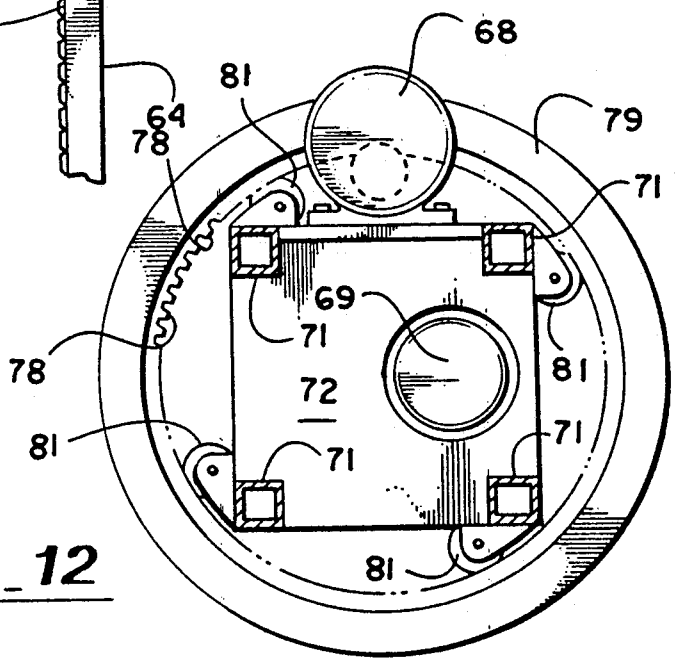
FIG. 12 is an enlarged partial vertical section view showing a portion of the drive mechanism which rotates the barrier prior to the barrier being recessed into the receiving well.
Figure 10:
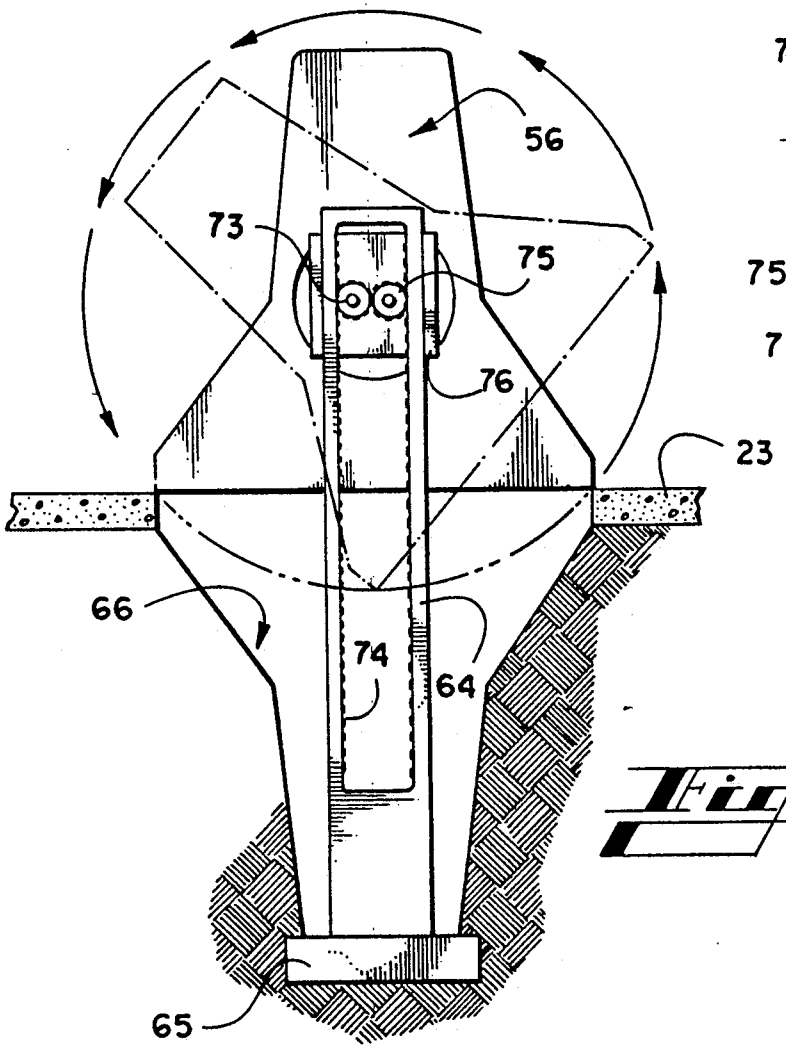
FIG. 10 is an end view of the barrier gate of the second embodiment of FIG. 9 looking toward the gate.

Referring now to FIG. 12, which shows the mechanism for revolving the barrier 56 about the core 63, it is seen that the rotational motor 68 is mounted to the reinforcing members 71 and the drive output of the rotational motor includes a drive gear 77 whose toothed outer rim engages matching rotational ring gear teeth 78 which are cut into the interior surface of the ring gear 79. The ring gear 79 is a portion of the gate 56 and is supported around the core 63 by means of supporting roller casters 81, which are allowed to ride adjacent the ring gear teeth 78 and to support the barrier 56 at four spaced locations to allow ease of turning.

Certain electrical wiring and other well known expedients are not shown in these figures for the sake of clarity, however, it would be a relatively easy task to effect suitable wiring. FIG. 9, however, does show the solar collector panel 47 supplying the battery bank of 67 through suitable wiring 82. While it might be questioned that the rotational aspects of the gate 56 might cause some wiring problems, it should be noted that the gate does not need to rotate more than 180 degrees in one direction and then rotate back in the same direction for a full operating cycle. Therefore, any wiring connection between the rotational portions of the mechanism and the stationary portion of the mechanism could be installed to account for the rotational movement.

Various modifications may be made of the invention without departing from the scope thereof, and it is desired, therefore, that only such limitations shall be placed thereon as are imposed by the prior art and which are set forth in the appended claims.

What is claimed is:

1. A traffic barrier for controlling the flow of vehicles comprising:

end walls flanking a vertically disposed and horizontally elongated movable gate, said gate being selectively movable vertically from an upright, closed position to an open substantially ground level position, said gate having a first side and a second side, said sides being connected by a top member, the first and second sides being pivotally connected to said top member, a reinforcing longitudinal support beam extending from one end wall to the other end wall, said beam supporting the top member, retractable support means extending from the support beam to ground level, lifting means to effect vertical movement of said gate upon command, said first and second sides of said gate being adapted to move about said pivotal connection at the top member as the gate is moved to its lowered open position wherein said first and second sides collapse to substantially ground level to provide a ramp surface.

2. A traffic barrier for controlling the flow of vehicles as claimed in claim 1, wherein said retractable support means being received into a ground mounted tube and adapted to be retracted therein when the gate is moved to the open position.

3. A traffic barrier for controlling the flow of vehicles as claimed in claim 2, wherein said lifting means is adapted to effect vertical movement of said gate upon command.

4. A traffic barrier, for controlling the flow of vehicles as claimed in claim 3, wherein said lifting means comprises a boom arm operatively engaged with the longitudinal support beam to selectively lower and raise the support beam to thereby collapse the gate to form a ground engaging ramp and to raise the gate to form a barrier.

5. A traffic barrier for controlling the flow of vehicles as claimed in claim 4, said barrier having actuating means for effecting movement of said boom arm, the boom arm being mounted for vertical movement and having one end thereof in juxtaposition with the longitudinal support beam and the other end thereof operatively engaged with said actuating means.

6. A traffic barrier for controlling the flow of vehicles as claimed in claim 5, said barrier having power transfer means to supply power to said actuating means upon command to effect movement of said boom arm.

7. A traffic barrier for controlling the flow of vehicles comprising:

end walls flanking a vertically disposed and horizontally elongated movable gate, said gate being selectively movable vertically from an upright closed position to a lowered open substantially ground level position, said gate having a first side and a second side, said sides being connected by a top member and a bottom member, said bottom member having a greater cross sectional area than the top member, a ground well area located adjacent to said gate adapted to receive said gate thereinto when said gate is in the lowered open position, lifting means to effect vertical movement of said gate upon command from a raised closed position to a lowered open position wherein the gate is received into the ground well area, said lifting means including track means to lower said gate into the ground well area and to subsequently raise the gate therefrom, rotational means to effect rotation of said gate a predetermined amount prior to said lifting means cycling said gate into the ground well area, power means operable upon command to cause the lifting means to cycle said gate into and out of the ground well area.

8. A traffic barrier for controlling the flow of vehicles as claimed in claim 7, comprising rotational means to effect rotation of said gate 180° to position the bottom member uppermost with respect to the top member prior to said lifting means cycling said gate into the ground well area.

9. A traffic barrier for controlling the flow of vehicles as claimed in claim 7, wherein said rotational means being operationally connected with the track means of the lifting means whereby when said lifting means cycles the gate into said receiving well the rotational means is carried into said receiving well.

10. A traffic barrier for controlling the flow of vehicles as claimed in claim 7, wherein said rotational means being mounted on a fixed non-revolving core within the gate.

11. A traffic barrier for controlling the flow of vehicles comprising:

end walls flanking a vertically disposed and horizontally elongated movable gate, said gate being selectively movable vertically from an upright closed position to a lowered open substantially ground level position, said sides being connected by a top member and a bottom member, said bottom member having a greater cross sectional area than the top member, a ground well area located adjacent to said gate adapted to receive said gate thereinto when said gate is in the lowered open position, lifting means to effect vertical movement of said gate upon command from a raised closed position to a lowered open position wherein the gate is received into the ground well area, said lifting means including track means to rotate and lower said gate into the ground well area and to subsequently raise and rotate the gate therefrom, said gate having opposed end walls which are respectively attached to the first and second sides and to the top and bottom members, said track means being integral with said end walls and flanking said end walls of said gate, power means operable upon command to cause the lifting means to cycle said gate into and out of the ground well area.

* * * * *